US007398915B1

(12) United States Patent
Pineda-Sanchez et al.

(10) Patent No.: US 7,398,915 B1
(45) Date of Patent: Jul. 15, 2008

(54) SECURITY MAILBOX ASSEMBLY, SYSTEM METHODS AND MONITORING SERVICE

(76) Inventors: Juan Ramon Pineda-Sanchez, 480 Julian St., Turlock, CA (US) 95380; Maria Garcia-Pineda, 480 Julian St., Turlock, CA (US) 95380

( * ) Notice: Subject to any disclaimer, the term of this patent is extended or adjusted under 35 U.S.C. 154(b) by 0 days.

(21) Appl. No.: 11/784,597

(22) Filed: Apr. 9, 2007

Related U.S. Application Data

(63) Continuation-in-part of application No. 10/839,270, filed on May 4, 2004, now Pat. No. 7,222,779.

(51) Int. Cl.
*A47G 29/12* (2006.01)

(52) U.S. Cl. ..... 232/36; 340/569

(58) Field of Classification Search ..... 232/34–36, 232/17, 45, 19; 340/569
See application file for complete search history.

(56) References Cited

U.S. PATENT DOCUMENTS 3,611,333 A * 10/1971 Conigliaro ..... 340/539.14
4,934,592 A * 6/1990 DiMenichi ..... 232/17
5,917,411 A * 6/1999 Baggarly ..... 340/569
5,950,919 A * 9/1999 Adams ..... 232/34
6,318,628 B1 * 11/2001 Pangburn ..... 232/17
6,831,558 B1 * 12/2004 Andrew ..... 340/539.2

* cited by examiner

*Primary Examiner*—William L. Miller

(57) ABSTRACT

The security mailbox assembly functions to prevent identity and mail theft. The security mailbox assembly comprises a lockable mailbox having an internal alarm system including a receiver and transmitter unit (1), functioning in cooperation with a home base device including an outgoing mail holder for placement of outgoing mail therein, the outgoing mail holder being located remote from the mailbox and including a second receiver and transmitter unit (2) for receiving radio wave signals from the first antenna transmitter and receiver, and to transmit the mailbox data information to a receiver and transmitter unit (3), or a remote security mailbox monitoring center in response to triggering of an activation input from the mailbox device, also including a remote control receiver and transmitter unit (3) adapted to be carried by an individual or the owner of the mailbox.

6 Claims, 6 Drawing Sheets

SECURITY MAILBOX ASSEMBLY.

THE SECURITY MAILBOX.

SECURITY MAILBOX ASSEMBLY.

THE OUTGOINGMAIL HOLDER

60.

54.

THE SECURITY MAILBOX SCHEMATIC DIAGRAM.

OUTGOING MAIL HOLDER SCHEMATIC DIAGRAM.

OUTGOING MAIL HOLDER SCHEMATIC DIAGRAM

SECURITY MAILBOX ASSEMBLY, SYSTEM METHODS AND MONITORING SERVICE

The instant application is a continuation-in-part of Ser. No. 10/839,270, filed May 4, 2004, now U.S. Pat. No. 7,222,779.

BACKGROUND OF THE INVENTION

1. Field of the Invention

The present invention relates to mailbox assembly and more particularly pertains to a new Security Mailbox Assembly for providing a user with a modified security mailbox, which will truly protect and secure your mail, The Security Mailbox Assembly functions to prevent identity and mail theft, The Security Mailbox Assembly comprises a lockable mailbox having an internal alarm system including a transmitter/receiver unit, functioning in cooperation with an outgoing mail holder including an additional receiver/transmitter unit, and a remote control receiver/transmitter unit adapted to be carried an individual.

In one embodiment the outgoing mail holder device would have the capability to be connected or plugged into a telephone jack to fully activate a Security Mailbox monitoring service using a telephone line, a security mailbox monitoring company could provide the monitoring service 24 hours a day 7 days a week to the subscriber for a monthly fee.

2. Prior Art References

The use of mailbox assemblies is known in the prior art (a) U.S. Pat. No. 5,917,411 by Baggarly, James H., (b) U.S. Pat. No. 6,318,628 by Pangburn, Daniel Wesley (c) U.S. Pat. No. 6,831,558 by Andrew, Robert B. (d) U.S. Pat. No. 5,950,919 by Adams, Melvin (e) U.S. Pat. No. 4,934,592 by DiMenichi, Dante S. (f) U.S. Pat. No. 3,611,333 by Conigliaro, Thomas S. While these devices fulfill their respective, particular objectives and requirements, the need remains for a device that includes that has certain improved features.

SUMMARY OF THE INVENTION

The present invention concerns that of a new and improved Security Mailbox Assembly, guaranteed to help prevent identity and mail theft. For use with rural, residential and any other type of mailbox desired, The Security Mailbox Assembly having at least one inner surface, two ends (front, back) two side panels (right, left) top and bottom surfaces, and coverlid or opening door with a handle on it, the top surface of the Security Mailbox will have a mail deposit aperture and lockable bracket, in the shape of a small square welded on two ends design for the lockable device to lock through the two non welded sides of the square providing a better protection to the Security Mailbox. The lockable bracket will be welded in the inner side of the top surface, The Security Mailbox Assembly will comprise a lockable compartment equipped with a special design compact weatherproof protected mailbox's alarm system including a transmitter and receiver unit, that will be mounted inside the inner surface of the Security Mailbox Assembly, the mailbox's alarm system will have adjustable impact and motion sensors that will trigger the mailbox's alarm system if Security Mailbox is being tampered with, it will have incorporated an (LED) signal light, to aware any passerby or potential thief that is functioning, it will also have an antenna, to provide a better radio wave signal transmission, and also be equipped with either pin switches or magnetic switches connected to the mailbox's alarm system, to protect the Security Mailbox deposit lockable compartment, coverlid or opening door, if someone would to attempt to force the mail deposit lockable compartment open, the mailbox alarm system will activate and emit load sounds subsequently will transmit a radio wave signal to an outgoing mail holder, (a home base device unit) that would include a second receiver and transmitter unit, the outgoing mail holder for placement of outgoing mail therein, the outgoing mail holder to be located remote from the mailbox and would include a second receiver for receiving mailbox data signals from the receiver and transmitter unit (the mailbox).

In one embodiment the outgoing mail holder having a telephone line-base mailbox monitoring System and communication interface, a telephone plug input built in, an antenna, display screen, a second signal light, an AC-DC power supply, and battery attachments for back-up battery power. The unit will be pre-programmed or adapted to initiate establishment of a communication link with a remote telecommunication mailbox monitoring center in response to triggering of an activation input from the mailbox device.

Another device that would also work in combination with the mailbox alarm system will be a remote control receiver and transmitter unit, for activating and deactivating the system, also including display screen, a built in antenna, and is going to be adapted to be carried by an individual or owner of the mailbox, the functions of this device are to notify it's carrier when mail has been delivered, or somebody is tampering with the mailbox, and as optional to lock and unlock the mailbox device.

SYSTEM METHODS AND MONITORING SERVICE

A device, system and methods for monitoring a subscriber's Mailbox that will include:

1. a Mailbox alarm system including a transmitter and receiver unit, 2. a transmitter and receiver unit, a home base device 3. a transmitter and receiver unit, adapted to be carried by an individual.

In one embodiment; when mail is deposit through the mail deposit aperture, the mailbox alarm system, would register a signal, subsequently would trigger a radio wave signal to the receiver and transmitter, which will indicate the mail has arrived. If someone would to attempt to force the mail deposit lockable compartment open, the mailbox alarm system, would activate and emit loud sounds through a multi-tone siren or speaker, preferable mounted facing out attached on the small outgoing sound apertures, subsequently the mailbox alarm system, will transmit a radio wave signal to the radio wave receiver and transmitter, by any mean possible, to alert that somebody is tampering with the Security Mailbox.

In another embodiment, when mail is deposit through the mail deposit aperture, the mailbox alarm system, would register a radio wave signal (mailbox data) to the receiver and transmitter unit, the unit will be pre-programmed or adapted to initiate establishment of a communication link with the receiver and transmitter unit, or a remote mailbox monitoring center preferable through a telephone line in response to triggering of an activation input from the mailbox device, the mailbox monitoring center will provide assistance by responding to the retrieved mailbox data signal, in some cases calls individuals to identify of the mailbox related problem, the mailbox monitoring center could also forward the mailbox data signal to the receiver and transmitter unit. For example: a pager, cell phone, computer, or any other device desired, or by any other means possible.

That has thus been outlined, rather broadly, the more important feature of The Security Mailbox system, monitoring service and methods that the detailed description thereof that follows may be better understood and in order that the presence contribution to the art may be better appreciated. There are of course, additional feature of The Security Mailbox that will be described hereinafter and which will form the subject matter of the claims appended hereto, in this respect, before explaining at least one embodiment of the Security Mailbox Assembly in detailed, it is to be understood that the Security Mailbox Assembly is not limited in it's application to the details of construction and to the arrangements of the components set forth in the following description or illustrated in the drawings, The Security Mailbox Assembly is capable of other embodiments and being practices and carried out in various ways further, since numerous modifications and changes will readily occur to those skilled in the art, it is not desired to the limit the invention to the exact construction and operations shown and accordingly all suitable modifications and equivalent may be resorted to falling within the scope of the invention, it's also to be understood that the phraseology and terminology employed herein are for the purpose of the descriptions and shall not be regarded as limiting.

It is an object to the present invention to provide a non-existing Security Mailbox assembly, which has all the advantages of prior art and non of disadvantages.

It is an object to the present invention to provide a mailbox security system to be mounted inside any existing mailbox desired examples: rural mailbox, residential etc.

It is an object to the present invention to provide a non existing device which will be an outgoing mail holder, in one embodiment it will include a telephone plug input, a receiver and transmitter, an antenna, a display screen, a signal light, an AC-DC power supply, and battery attachments for back-up battery power.

It is an object to the present invention to provide a new and non-existing method of service to subscribers, "mailbox monitoring service" which has all the advantages of prior art and none of disadvantages.

It is an object of the present invention to truly provide a 24 hours of mailbox protection and monitoring service through a telecommunication system, wireless communication, satellite or any other means possible.

Yet the most important object of the present invention is to stop the mail theft and especially identity theft, a worldwide problem that is affecting every one of us. The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof Such description makes reference to the annexed drawings wherein:

FIG. 9 (B) the outgoing mail holder unit device, schematic diagram.

DESCRIPTION OF THE PREFERRED EMBODIMENT

Figure 1:
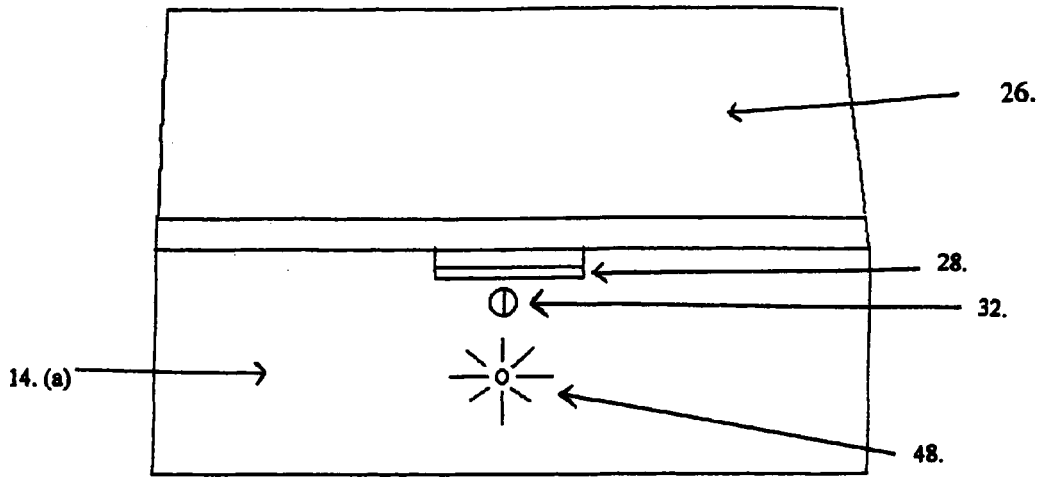
FIG. 1 is a front view of a residential security mailbox.
Figure 3:
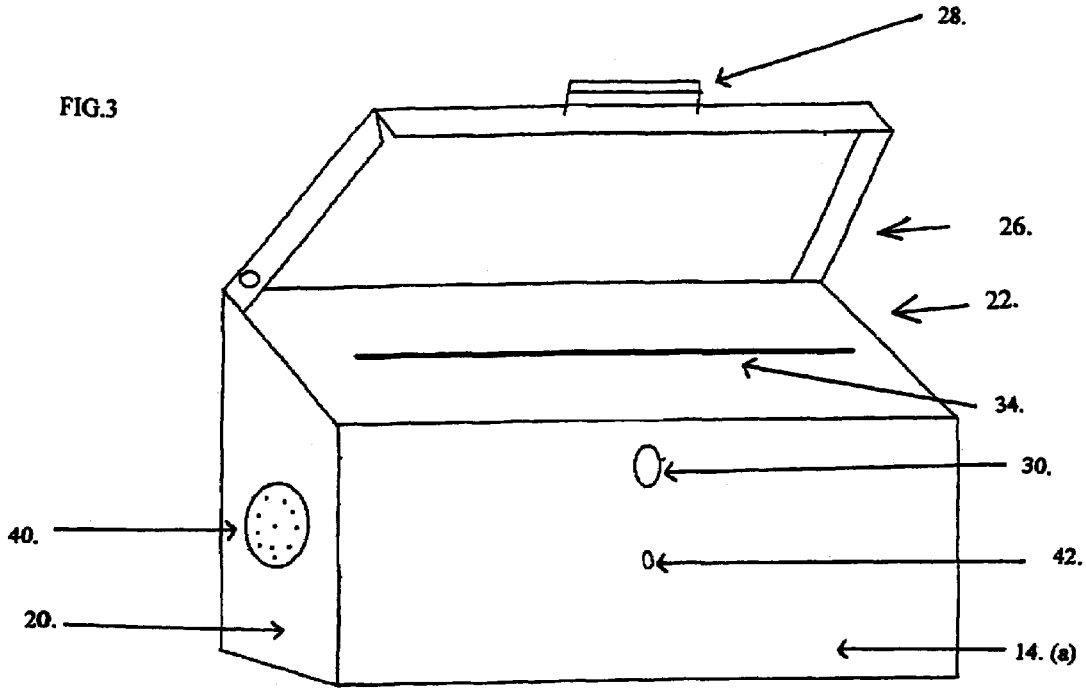
FIG. 3 is a view of the residential security mailbox with the lid open.
Figure 5:
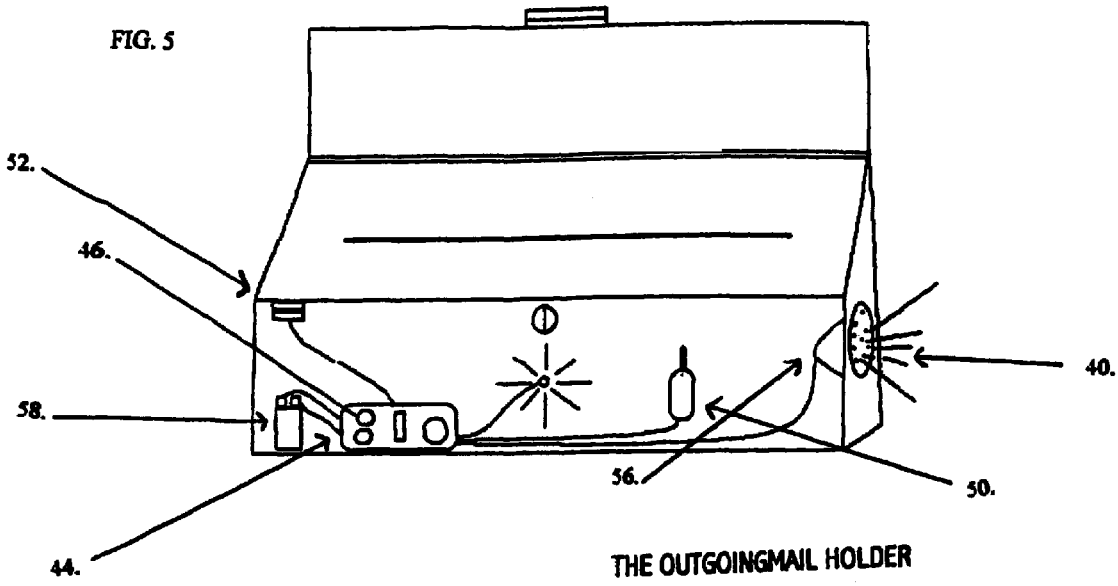
FIG. 5 is an inside view of the residential security mailbox showing the alarm system.

Residential Security Mailbox:

A best illustrated in FIGS. 1 and 3 the Security Mailbox Assembly generally comprising a mailbox, the mailbox having at least one inner surface, the mailbox having two ends, a front end 14 (*a*), and back end, two side panels, right side, and left side 20, top and bottom surfaces, top surface 22, and bottom surface, and a cover lid 26, with a handle on it 28, the Security Mailbox, will also comprise a lockable aperture 30, where a locking device 32, will be placed. On the top surface 22, of the Security Mailbox, will have a mail deposit aperture 34, also lockable bracket, The mail deposit aperture 34 will be placed on the middle section of the top surface 22, the lockable bracket, will be welded in the inner surface, of the top surface 22, of The Security Mailbox, the lockable bracket, will work to the locking device 32, providing a locking compartment, The Security Mailbox, will also have small outgoing sound apertures 40, and signal light aperture 42, As shown in FIG. 5, a special designed compact, weatherproof, protected, mailbox alarm system 44, that will include a receiver and transmitter unit, and will be mounted inside the inner surface 12, of the Security Mailbox. The mailbox alarm system 44, will have adjustable impact and motion sensor 46, that will trigger the mailbox system 44, if the Security Mailbox is being tampered with.

The Security mailbox, will also have incorporated an (LED) signal light 48, placed through the signal light aperture 42, on the front end 14 (*a*), of the Security Mailbox, (LED) signal light 48, to aware any passerby or potential thief that the Security Mailbox, is functioning. The Security Mailbox, will have an antenna 50, to provide a better radio wave signal transmission, The Security Mailbox, will also be equipped with either pin switches or magnetic switches 52, connected to the mailbox alarm system 44, to protect the Security Mailbox lockable compartment, and cover lid 26.

In one embodiment; when mail is deposit through the mail deposit aperture 34, the mailbox alarm system 44, would register a signal, subsequently would trigger a radio wave signal to the receiver and transmitter 54 by any means possible, which will indicate the mail has arrived, if someone would to attempt to force the mail deposit lockable compartment open, the mailbox alarm system 44, would activate and emit loud sounds through a multi-tone siren or speaker 56, preferable mounted facing out attached on the small outgoing sound apertures 40, subsequently the mailbox alarm system 44, will transmit a radio wave signal to the radio wave receiver and transmitter 54, (FIG. 7) by any means possible to alert that somebody is tampering with the Security Mailbox.

In another embodiment; when mail is deposit through the mail deposit aperture, the mailbox alarm 5 system unit, would register a radio wave signal (mailbox data) to the outgoing mail holder 64 which includes a receiver and transmitter unit, (a home base device unit) that will be pre-programmed or adapted to initiate establishment of a communication link with a remote mailbox monitoring center 80 in response to triggering of an activation input from the mailbox device, preferable through a telephone line, the security mailbox monitoring center could provide the monitoring service 24 hours a day 7 days a week to the subscriber for a monthly fee, the mailbox monitoring center could provide assistance by responding to the retrieved mailbox data signal, in some cases calls individuals to identify of a mailbox related problem. The security mailbox monitoring center could also forward the mailbox data signal to the receiver and transmitter 54, For example: a pager, cell phone, computer, or any other device desired, or by any other means possible.

The Security Mailbox, will work by battery power operated. A battery or batteries will be attached to a battery attachment 58, to supply power to Security Mailbox.

Figure 6:
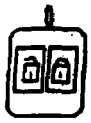
FIG. 6 is a remote control transmitter.

As shown in FIG. 6, as optional a radio wave remote control transmitter 60, could work coupled to the mailbox alarm system 44, to activate and deactivate mailbox alarm system 44, (on/off), and also as optional to lock and unlock the mailbox device, the radio wave remote control transmitter 60, preferable located within an individual.

Figure 7:
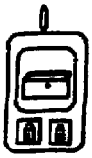
FIG. 7 is a receiver and transmitter unit.

As shown in FIG. 7, a remote control receiver and transmitter unit 54, for activating and deactivating the system, also including display screen, a built in antenna, and is going to be adapted to be carried by an individual or owner of the mailbox, the functions of this device are to notify it's carrier when mail has been delivered, or somebody is tampering with the mailbox, and as optional to lock and unlock the mailbox device.

Figure 8:
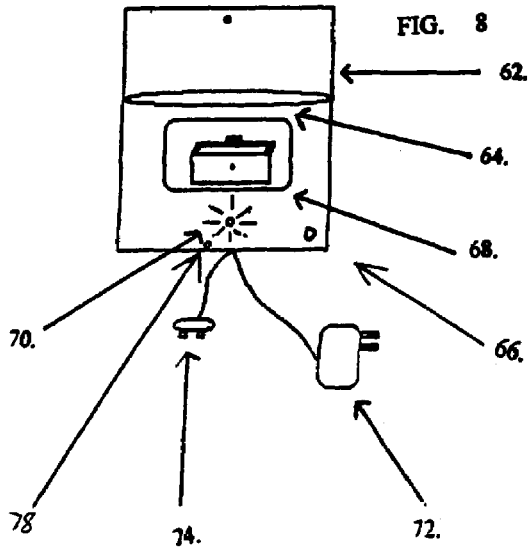
FIG. 8 is an outgoing mail holder unit device.
Figure 9:
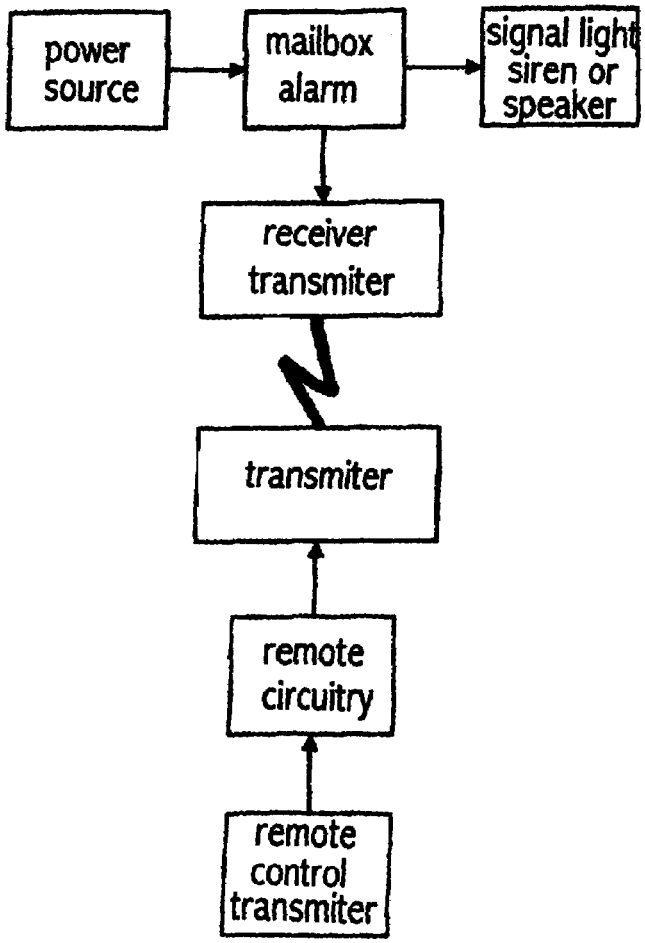
FIG. 9 (A) is a security mailbox schematic diagram.
Figure 9:
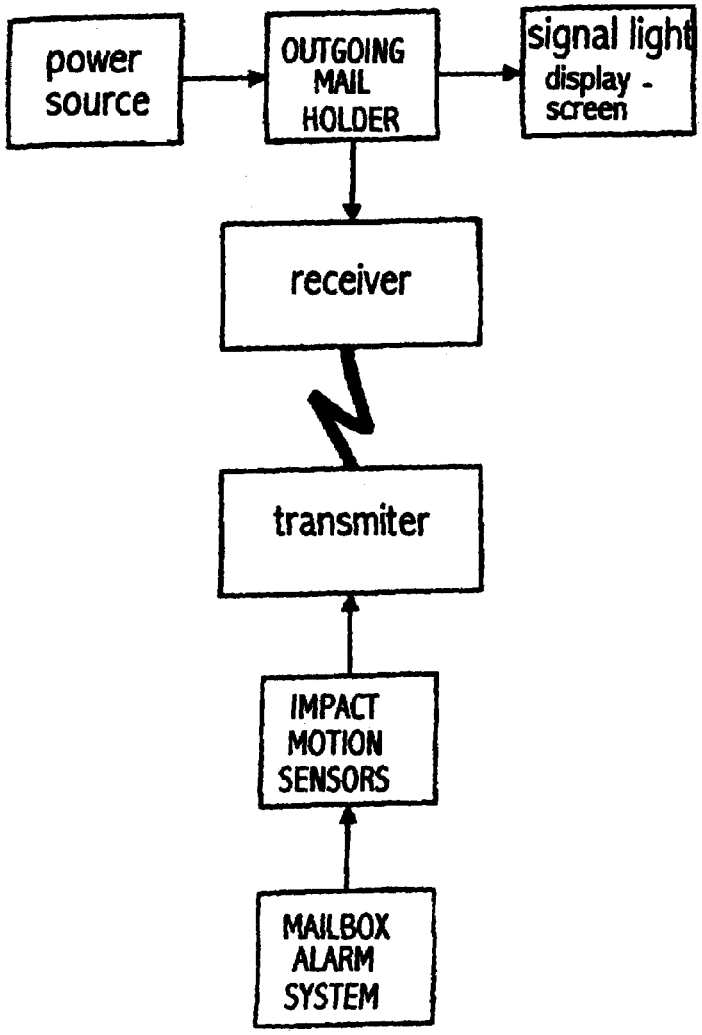
Figure 10:
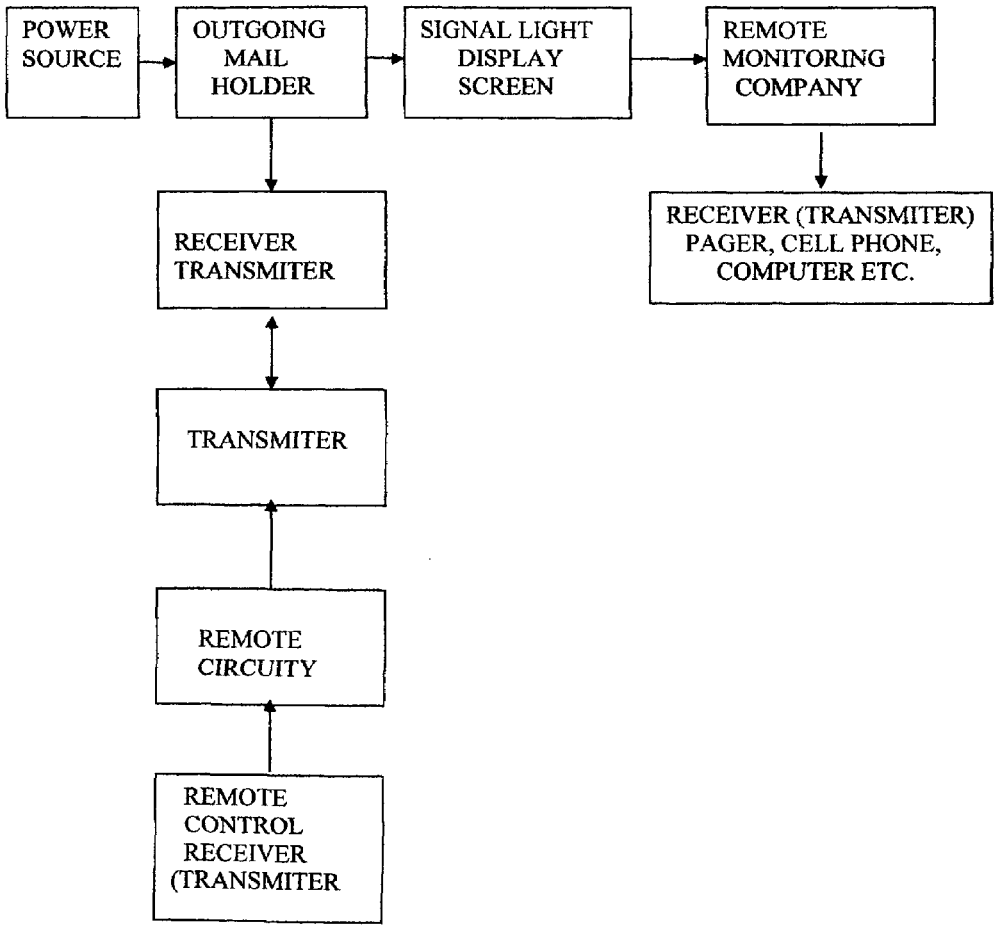
FIG. 10 is a remote mailbox monitoring center

As shown in FIG. 8, also working coupled to the mailbox alarm system 44, will be a new device for outgoing mail which will be an outgoing mail holder 62.

Figure 2:
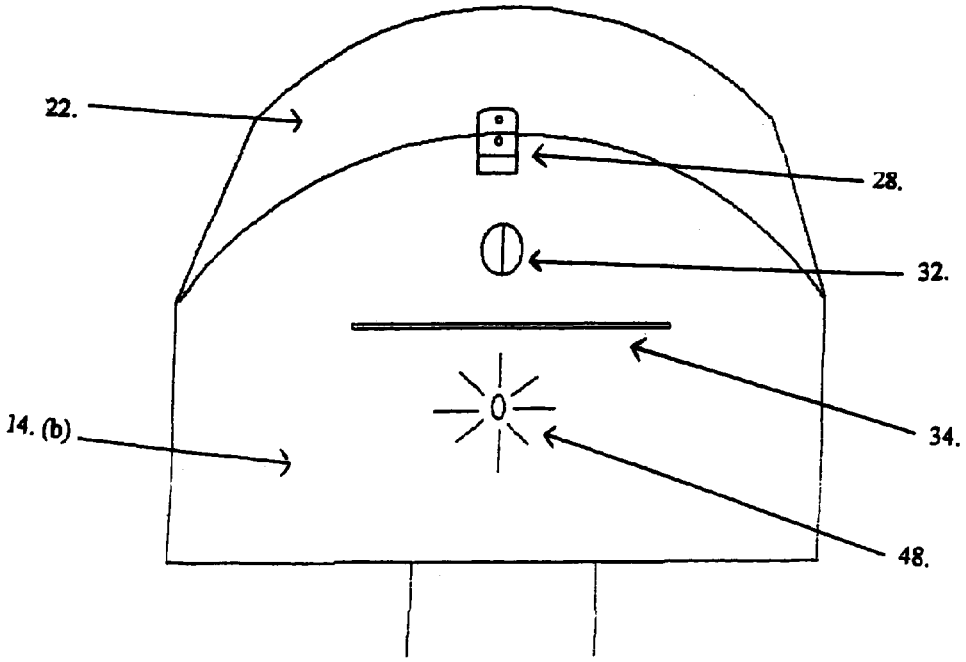
FIG. 2 is a front view of a rural security mailbox.
Figure 4:
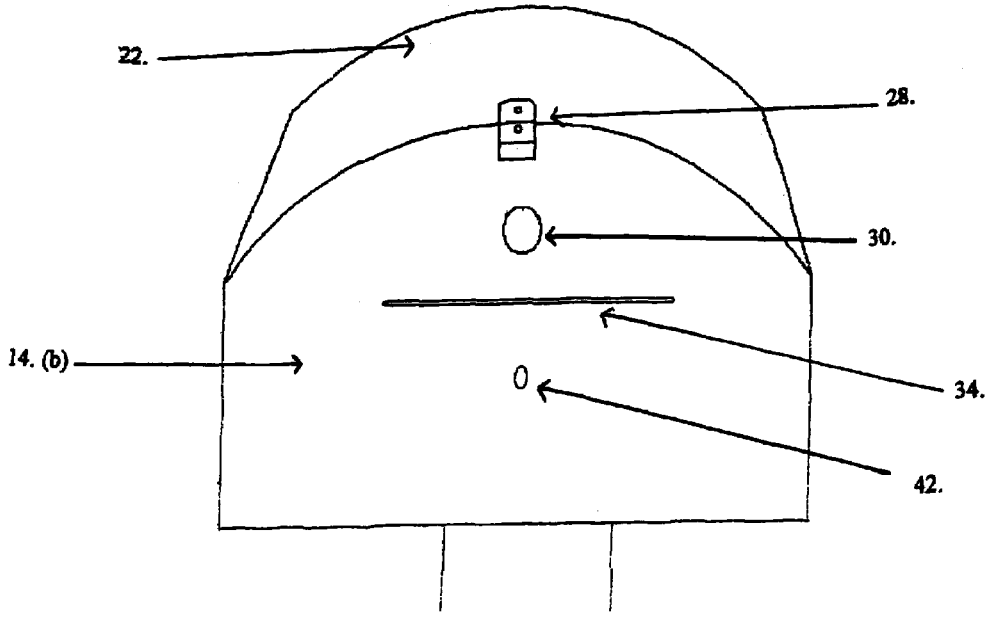
FIG. 4 is a front view of the rural security mailbox.

Rural Security Mailbox:

As best illustrated in FIGS. 2 and 4, the Security Mailbox Assembly, generally comprising a mailbox, the mailbox having at least one inner surface, the mailbox having two ends, front cover, (opening door) 14 (*b*), and back end, two side panels, right side, and left side 20, top and bottom surface 22, and bottom surface, opening door handle 28.

The front cover, (opening door) 14 (*b*), of the Security Mailbox, will also comprise a lockable aperture 30, where a lockable device 32, will be placed. On the front cover, (opening door) 14 (*b*), of The Security Mailbox, will have a mail deposit aperture 34, and a lockable bracket. The deposit mail aperture 34 will be placed on the middle section of the front cover, (opening door) 14 (*b*), and the lockable bracket, will be welded in the inner surface, of the top surface 22, of The Security Mailbox, the lockable bracket, will work coupled to the locking device 32, providing a locking compartment.

The Security Mailbox, will also have smalls outgoing sound apertures 40, and signal light aperture 42. As shown in FIG. 5, and as previously described with reference to the residential Security Mailbox, a special design compact, weatherproof, protected, mailbox alarm system that will also include a receiver and transmitter unit, that will be mounted inside the inner surface, of the Security Mailbox, the mailbox alarm system 44, will have adjustable impact and motion sensor 46, that will trigger the mailbox alarm system 44, if the Security Mailbox is being tampered with.

The Security mailbox will also have incorporated an (LED) signal light 48, placed through the signal light aperture 42, on the front cover (opening door) 14 (*b*), of the Security Mailbox, (LED) signal light 48, to aware any passerby or potential thief that the Security Mailbox is functioning.

The Security Mailbox, will have an antenna 50, to provide a better radio wave signal transmission, The Security Mailbox will be equipped with either pin switches or magnetic switches 52, connected to the mailbox alarm system 44, to protect the Security Mailbox lockable compartment.

In one embodiment; when mail is deposit through the mail deposit aperture 34, the mailbox alarm system 44, would register a signal subsequently would trigger a radio wave signal to the receiver and transmitter 54, which will indicate the mail has arrived, if someone would to attempt to force the mail deposit lockable compartment open, the mailbox alarm system 44, would activate and emit loud sounds through a multi-tone siren or speaker 56, preferable mounted facing out attached on the small outgoing sound apertures 40, subsequently the mailbox alarm system 44, will transmit a radio wave signal to the radio wave receiver and transmitter 54, (FIG. 7) in another embodiment; when mail is deposit through the mail deposit aperture, the mailbox alarm system unit, would register a radio wave signal (mailbox data) to the outgoing mail holder 64 which includes a receiver and transmitter unit (a home base device), the unit will be pre-programmed or adapted to initiate establishment of a communication link with a remote mailbox monitoring center 80 in response to triggering of an activation input from the mailbox device, preferable through a telephone line, the security mailbox monitoring center could provide the monitoring service 24 hours a day 7 days a week to the subscriber for a monthly fee, the mailbox monitoring center could provide assistance by responding to the retrieved mailbox data signal, in some cases calls individuals to identify of a mailbox related problem. The security mailbox monitoring center could also forward the mailbox data signal to the receiver and transmitter unit 54, For example: a pager, cell phone, computer, or any other device desired, or by any other means possible.

The Security Mailbox will work by battery power operated. A battery or batteries will be attached to a battery attachment 58, to supply power to Security Mailbox.

As shown in FIG. 6, a radio wave remote control transmitter 60, will work coupled to the mailbox alarm system 44, to activate and deactivate mailbox alarm system 44, (on/off) as optional the radio wave remote control transmitter 60, could be use to lock and unlock the mailbox device, the radio wave remote control transmitter 60, preferable located within an individual.

As shown in FIG. 7, a remote control receiver and transmitter unit 54, for activating and deactivating the system, also including display screen, a built in antenna, and is going to be adapted to be carried by an individual or owner of the mailbox, the functions of this device are to notify it's carrier when mail has been delivered, or somebody is tampering with the mailbox, and as optional to lock and unlock the mailbox device.

As shown in FIG. 8, also working coupled to the mailbox alarm system 44, will be a new device for outgoing mail which will be an outgoing mail holder 62.

We claim:

1. A residential security mailbox assembly comprising: a mailbox having a front, back, two sides, openable top, and bottom collectively defining an interior compartment for receiving and storing mail, the mailbox further including a mail deposit aperture in the top for inserting mail therethrough wherein the mail deposit aperture is in communication with the interior compartment, a movable lid attached to the mailbox for covering and uncovering the mail deposit slot aperture, a locking device for locking and unlocking the openable top, a first signal light mounted to the front, and sound apertures formed in one of the sides;

an alarm system positioned within the interior compartment, the alarm system including a battery power supply, an impact and motion sensor, a first antenna receiver and transmitter for receiving and transmitting radio wave signals, a magnetic switch device, and an audible speaker for emitting sounds through the sound apertures, wherein the first signal light when illuminated indicates the alarm system is functioning;

an outgoing mail holder for placement of outgoing mail therein, the outgoing mail holder being located remote from the mailbox and including a second receiver and transmitter for receiving radio wave signals from the first antenna transmitter and receiver, and to transmitting radio wave signals to a third receiver and transmitter unit or a remote security mailbox monitoring center, the outgoing mail holder also including a display screen, a second signal light, an antenna, a built in telephone line plug input, an AC-DC power supply, and battery attachments for back-up battery power, a remote control transmitter for activation and deactivation of the alarm system, and to lock and unlock the mailbox, the remote control transmitter adapted to be carried by an individual or an owner of the mailbox.

2. A rural security mailbox assembly comprising: a mailbox having an openable front door, back, two sides, top, and bottom collectively defining an interior compartment for receiving and storing mail, the mailbox further including a mail deposit aperture in the door for inserting mail therethrough wherein the mail deposit aperture is in communication with the interior compartment, a locking device for locking and unlocking the door, a first signal light mounted to the door, and sound apertures formed in one of the sides;

an alarm system positioned within the interior compartment, the alarm system including a battery power supply, an impact and motion sensor, a first antenna receiver and transmitter for receiving and transmitting radio wave signals, a magnetic switch device, and an audible speaker for emitting sounds through the sound apertures, wherein the first signal light when illuminated indicates the alarm system is functioning;

an outgoing mail holder for placement of outgoing mail therein, the outgoing mail holder being located remote from the mailbox and including a second receiver and transmitter for receiving radio wave signals from the first antenna transmitter and receiver, and transmitting radio wave signals to a third receiver and transmitter unit or a remote security mailbox monitoring center, the outgoing mail holder also including a display screen, a second signal light, an antenna, a built in telephone line plug input, an AC-DC power supply, and battery attachments for back-up battery power, a remote control transmitter for activation and deactivation of the alarm system, and to lock and unlock the mailbox, the remote control transmitter adapted to be carried by an individual or an owner of the mailbox.

3. The residential security mailbox assembly of claim 1, wherein the third receiver and transmitter unit is for receiving radio wave signals from the first or second transmitter and receiver, the third receiver and transmitter unit including a display screen, a built in antenna, and adapted to be carried by an individual or owner of the mailbox, the functions of the third receiver and transmitter unit are to notify the individual or owner when mail has been delivered, when somebody is tampering with the mailbox, and also for activation and deactivation of the alarm system.

4. A method of using the residential security mailbox assembly of claim 1, wherein the outgoing mail holder is pre-programmed or adapted to communicate with the remote security mailbox monitoring center via a telephone line in response to mailbox activity, providing 24 hours a day 7 days a week of mailbox monitoring service for a monthly fee if subscribed, the remote security mailbox monitoring center capable of calling individuals to notify of the mailbox activity, and capable of forwarding data to the third receiver and transmitter unit wherein the third receiver and transmitter unit is a pager, cell phone, computer, or other electronic communication device.

5. The rural security mailbox assembly of claim 2, wherein the third receiver and transmitter unit is for receiving radio wave signals from the first or second transmitter and receiver, the third receiver and transmitter unit including a display screen, a built in antenna, and adapted to be carried by an individual or owner of the mailbox, the functions of the third receiver and transmitter unit are to notify the individual or owner when mail has been delivered, when somebody is tampering with the mailbox, and also for activation and deactivation of the alarm system.

6. A method of using the rural security mailbox assembly of claim 2, wherein the outgoing mail holder is pre-programmed or adapted to communicate with the remote security mailbox monitoring center via a telephone line in response to mailbox activity, providing 24 hours a day 7 days a week of mailbox monitoring service for a monthly fee if subscribed, the remote security mailbox monitoring center capable of calling individuals to notify of the mailbox activity, and capable of forwarding data to the third receiver and transmitter unit wherein the third receiver and transmitter unit is a pager, cell phone, computer, or other electronic communication device.

* * * * *